US009587340B2

(12) United States Patent
Jenkins et al.

(10) Patent No.: US 9,587,340 B2
(45) **Date of Patent: *Mar. 7, 2017**

(54) CLEANING APPARATUS USING SOLID PARTICULATE CLEANING MATERIAL

(75) Inventors: Stephen Derek Jenkins, Middlesbrough (GB); Frazer John Kennedy, Sheffield (GB)

(73) Assignee: XEROS LIMITED, Rotherham (GB)

( * ) Notice: Subject to any disclaimer, the term of this patent is extended or adjusted under 35 U.S.C. 154(b) by 822 days.

This patent is subject to a terminal disclaimer.

(21) Appl. No.: 13/577,528

(22) PCT Filed: Feb. 10, 2011

(86) PCT No.: PCT/GB2011/050243

§ 371 (c)(1),
(2), (4) Date: Aug. 7, 2012

(87) PCT Pub. No.: WO2011/098815

PCT Pub. Date: Aug. 18, 2011

(65) Prior Publication Data

US 2012/0304400 A1 Dec. 6, 2012

(30) Foreign Application Priority Data

Feb. 10, 2010 (GB) ..... 1002245.7

(51) Int. Cl.
*D06F 35/00* (2006.01)
*D06F 23/02* (2006.01)

(52) U.S. Cl.
CPC ..... *D06F 35/00* (2013.01); *D06F 23/02* (2013.01)

(58) Field of Classification Search
CPC ..... D06F 35/00; D06F 35/006; D06F 39/02; D06F 39/083; D06F 39/088; D06F 39/026;
(Continued)

(56) References Cited

U.S. PATENT DOCUMENTS 3,323,159 A * 6/1967 Ummel ..... A47L 15/0002 134/110
3,425,078 A * 2/1969 Lazaga ..... 15/3
(Continued)

FOREIGN PATENT DOCUMENTS

CN 102061589 A 5/2011
DE 1900002 A1 7/1970
(Continued)

*Primary Examiner* — Joseph L Perrin
*Assistant Examiner* — Irina Graf
(74) *Attorney, Agent, or Firm* — Nexsen Pruet, PLLC; E. Eric Mills

(57) ABSTRACT

There is disclosed an apparatus and method for use in the cleaning of soiled substrates, the apparatus including housing means having a first upper chamber having mounted therein a rotatably mounted cylindrical cage and a second lower chamber located beneath the cylindrical cage; at least one recirculation means; access means; pumping means and a multiplicity of delivery means, wherein the rotatably mounted cylindrical cage includes a drum including perforated side walls wherein up to 60% of the surface area of the side walls includes perforations and the perforations include holes having a diameter of no greater than 25.0 mm. The method carried out by the apparatus involves cleaning a soiled substrate by treatment of the moistened substrate with a formulation including solid particulate cleaning material and wash water.

16 Claims, 6 Drawing Sheets

(58) Field of Classification Search
CPC .. D06F 39/10; D06F 2204/082; D06F 23/025; D06F 23/02
See application file for complete search history.

(56) References Cited

U.S. PATENT DOCUMENTS

| | | | | | |
|---|---|---|---|---|---|
| 4,959,930 | A * | 10/1990 | Tsutsumi | A47L 15/0002 | 134/7 |
| 5,093,948 | A * | 3/1992 | Val | D06B 11/0096 | 68/29 |
| 5,161,394 | A | 11/1992 | Felzer et al. | | |
| 5,245,722 | A * | 9/1993 | Dameron | D06F 35/00 | 68/29 |
| 5,657,650 | A | 8/1997 | Lee et al. | | |
| 2002/0133886 | A1* | 9/2002 | Severns et al. | 8/142 | |
| 2003/0196459 | A1* | 10/2003 | Ions | 68/12.14 | |
| 2008/0090746 | A1 | 4/2008 | Penninger | | |
| 2008/0271498 | A1 | 11/2008 | Czyzewski et al. | | |
| 2009/0217461 | A1 | 9/2009 | Burkinshaw et al. | | |
| 2010/0064736 | A1 | 3/2010 | Jeong et al. | | |
| 2010/0326142 | A1 | 12/2010 | Geyer et al. | | |

FOREIGN PATENT DOCUMENTS

| | | | | | |
|---|---|---|---|---|---|
| DE | 4310006 | A1 | 10/1993 | | |
| DE | 102005026522 | A1 | 12/2006 | | |
| EP | 0016895 | A1 * | 10/1980 | A47L 15/0002 | |
| EP | 0795639 | A2 | 9/1997 | | |
| EP | 1118704 | A1 | 7/2001 | | |
| EP | 1371718 | A1 | 12/2003 | | |
| EP | 1865101 | A1 | 12/2007 | | |
| EP | 2664703 | A1 | 11/2013 | | |
| GB | 2364716 | A | 2/2002 | | |
| IT | EP 1832218 | A1 * | 9/2007 | A47L 15/0081 | |
| JP | S60-247199 | | 12/1985 | | |
| JP | H01-020897 | | 1/1989 | | |
| JP | H02-077292 | | 3/1990 | | |
| JP | H03-045296 | | 2/1991 | | |
| JP | H04-256477 | | 9/1992 | | |
| JP | 2004-194876 | | 7/2004 | | |
| JP | 2005-095448 | | 4/2005 | | |
| JP | 2005-304992 | | 11/2005 | | |
| JP | 2009-077745 | | 4/2009 | | |
| JP | 2009-532201 | | 9/2009 | | |
| TW | 193648 | | 6/1981 | | |
| WO | 2010094959 | A1 | 8/2010 | | |
| WO | 2011064581 | A1 | 6/2011 | | |

* cited by examiner

UNCLEANED XEROS STANDARD STAIN SET

STAIN SET L* CLEANING RESULTS BY STAIN TYPE

STAIN SET L* CLEANING RESULTS BY AVERAGE OVER ALL STAINS

STAIN SET L* CLEANING RESULTS - SEBUM

STAIN SET L* REDEPOSITION RESULTS

CLEANING APPARATUS USING SOLID PARTICULATE CLEANING MATERIAL

FIELD OF THE INVENTION

The present invention relates to the aqueous cleaning of substrates using a cleaning system which requires the use of only limited quantities of energy, water and detergent. Most particularly, the invention is concerned with the cleaning of textile fibres and fabrics by means of such a system, and provides an apparatus adapted for use in this context.

BACKGROUND TO THE INVENTION

Aqueous cleaning processes are a mainstay of both domestic and industrial textile fabric washing. On the assumption that the desired level of cleaning is achieved, the efficacy of such processes is usually characterised by their levels of consumption of energy, water and detergent. In general, the lower the requirements with regard to these three components, the more efficient the washing process is deemed. The downstream effect of reduced water and detergent consumption is also significant, as this minimises the need for disposal of aqueous effluent, which is both extremely costly and detrimental to the environment.

Such washing processes involve aqueous submersion of fabrics followed by soil removal, aqueous soil suspension, and water rinsing. In general, within practical limits, the higher the level of energy (or temperature), water and detergent which is used, the better the cleaning. The key issue, however, concerns water consumption, as this sets the energy requirements (in order to heat the wash water), and the detergent dosage (to achieve the desired detergent concentration). In addition, the water usage level defines the mechanical action of the process on the fabric, which is another important performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. reduce energy, water and detergent consumption), and the need for efficient mechanical action in the wash. For domestic washing in particular there are defined wash performance standards specifically designed to discourage the use of such higher levels in practice, in addition to the obvious cost penalties which are associated with such usage.

Current efficient domestic washing machines have made significant strides towards minimising their consumptions of energy, water and detergent. EU Directive 92/75/CEE sets a standard which defines washing machine energy consumption in kWh/cycle (cotton setting at 60° C.), such that an efficient domestic washing machine will typically consume<0.19 kWh/kg of washload in order to obtain an 'A' rating. If water consumption is also considered, then 'A' rated machines use <9.7 liters/kg of washload, whilst the most efficient modern machines are now capable of using even less water—e.g. model number F1480FD6 manufactured by LG (see www.lg.com). This machine typically uses 63 liters for a 9 kg washload, i.e. 7 liters/kg.

Detergent dosage is then driven by manufacturer recommendations but, again, in the domestic market, for a concentrated liquid formulation, a figure of 35 ml (or 37 g) for a 4-6 kg washload in soft and medium hardness water, increasing to 52 ml (or 55 g) for a 6-8 kg washload (or in hard water or for very dirty items) is typical (see, for example, Unilever pack dosage instructions for Persil® Small & Mighty). Hence, for a 4-6 kg washload in soft/medium water hardness, this equates to a detergent dosage of 7.4-9.2 g/kg whilst, for a 6-8 kg washload (or in hard water or for very dirty items), the range is 6.9-9.2 g/kg.

Energy, water and detergent consumptions in the industrial washing process (washer-extractors) are considerably different, however, and usages of energy and water are less constrained in such environments, since these are principal factors in reducing cycle time—which is, of course, more of a consideration than in the domestic scenario. There is a similar pressure on detergent levels, however, but this is mostly due to a desire to reduce cost.

Thus, it can be taken from the above discussion that the performance levels which set the highest standard for an efficient fabric washing process are an energy consumption of <0.19 kWh/kg, a water usage of approximately 7 liters/kg, and a detergent dosage of approximately 8 g/kg. However, as already mentioned, it is becoming increasingly difficult to reduce the water (and, hence, energy and detergent) levels in a purely aqueous process, due to the minimum requirement to wet the fabric thoroughly, the need to provide sufficient excess water to suspend the soil removed in an aqueous liquor and, finally, the need to rinse the fabric.

Heating of the wash water is then the principal use of energy, and a minimum level of detergent becomes necessary in order for an effective concentration to be reached at the operating wash temperature. If a means to improve mechanical action could be achieved without increasing the water level used, then the aqueous wash process could become significantly more efficient (i.e. yield further reductions in energy, water and detergent consumption). It should be noted that mechanical action itself has a direct effect on the detergent level, since the greater the level of soil removal which is achieved through physical force, the less that is required of the detergent chemistry. However, increasing the mechanical action in a purely aqueous washing process has certain associated drawbacks. Fabric creasing readily occurs in such processes, and this acts to concentrate the stresses from mechanical action at each crease, resulting in localised fabric damage. Prevention of such fabric damage (i.e. fabric care) is of primary concern to the domestic consumer and the industrial user.

Various different approaches to the development of new cleaning technologies have been reported in the prior art, including methods which rely on electrolytic cleaning or plasma cleaning, in addition to approaches which are based on ozone technology, ultrasonic technology or steam technology. Thus, for example, WO-A-2009/021919 teaches a fabric cleaning and disinfection process which utilises UV-produced ozone along with plasma. An alternative technology involves cold water washing in the presence of specified enzymes, whilst a further approach which is particularly favoured relies on air-wash technology and, for example, is disclosed in US-A-2009/0090138. In addition, various carbon dioxide cleaning technologies have been developed, such as the methods using ester additives and dense phase gas treatments which are described in U.S. Pat. No. 7,481,893 and US-A-2008/0223406, although such methods generally find greater applicability in the field of dry cleaning. Many of these technologies are, however, technically complex and not readily suited to domestic applications, in particular.

In the light of the challenges which are associated with aqueous washing processes, the present inventors have previously devised a new approach to the problem, which is technologically straightforward, and yet still allows the deficiencies demonstrated by the methods of the prior art to be overcome. The method which is provided eliminates the requirement for the use of large volumes of water, but is still capable of providing an efficient means of cleaning and stain removal, whilst also yielding economic and environmental benefits.

Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. Preferably, the substrate is wetted so as to achieve a substrate to water ratio of between 1:0.1 to 1:5 w/w, and optionally, the formulation additionally comprises at least one cleaning material, which typically comprises a surfactant, which most preferably has detergent properties. In preferred embodiments, the substrate comprises a textile fibre and the polymeric particles may, for example, comprise particles of polyamides, polyesters, polyalkenes, polyurethanes or their copolymers, but are most preferably in the form of nylon chips.

The use of this cleaning method, however, presents a requirement for the cleaning chips or beads to be efficiently separated from the cleaned substrate at the conclusion of the cleaning operation, and this issue was initially addressed in WO-A-2010/094959, which provides a novel design of cleaning apparatus requiring the use of two internal drums capable of independent rotation, and which finds application in both industrial and domestic cleaning processes.

With a view to providing a simpler, more economical means for addressing the problem of efficient separation of the cleaning media from the substrate at the conclusion of the cleaning process, however, a further apparatus is disclosed in co-pending PCT Patent Application No. PCT/GB2010/051960. The apparatus of PCT Patent Application No. PCT/GB2010/051960, which finds application in both industrial and domestic cleaning processes, comprises a perforated drum and a removable outer drum skin which is adapted to prevent the ingress or egress of fluids and solid particulate matter from the interior of the drum. The cleaning method requires attachment of the outer skin to the drum during a first wash cycle, after which the skin is removed prior to operating a second wash cycle, following which the cleaned substrate is removed from the drum.

The apparatus and method of PCT Patent Application No. PCT/GB2010/051960 is found to be extremely effective in successfully cleaning substrates, but the requirement for the attachment and removal of the outer skin detracts from the overall efficiency of the process and the present inventors have, therefore, sought to address this aspect of the cleaning operation and to provide a process wherein this procedural step is no longer necessary. Thus, by providing for continuous circulation of the cleaning chips during the cleaning process, it has been found possible to dispense with the requirement for the provision of an outer skin.

SUMMARY OF THE INVENTION

Thus, according to a first aspect of the present invention, there is provided an apparatus for use in the cleaning of soiled substrates, said apparatus comprising:

(a) housing means, having:

(i) a first upper chamber having mounted therein a rotatably mounted cylindrical cage, and (ii) a second lower chamber located beneath said cylindrical cage;

(b) at least one recirculation means;

(c) access means;

(d) pumping means; and (e) a multiplicity of delivery means, wherein said rotatably mounted cylindrical cage comprises a drum comprising perforated side walls, wherein up to 60% of the surface area of said side walls comprises perforations, and said perforations comprise holes having a diameter of no greater than 25.0 mm.

In preferred embodiments of the invention, no more than 50%, more preferably no more than 40%, of the side walls comprises perforations.

Preferably, said perforations comprise holes having a diameter of from 2 to 25 mm, preferably from 4 to 10 mm, most preferably from 5 to 8 mm.

Said access means typically comprises a hinged door mounted in the casing, which may be opened to allow access to the inside of the cylindrical cage, and which may be closed in order to provide a substantially sealed system. Preferably, the door includes a window. Optionally, said door also includes at least one addition port which facilitates the addition of materials to said rotatably mounted cylindrical cage.

Said rotatably mounted cylindrical cage may be mounted vertically within said housing means but, most preferably, is mounted horizontally within said housing means. Consequently, in preferred embodiments of the invention, said access means is located in the front of the apparatus, providing a front-loading facility. When the rotatably mounted cylindrical cage is vertically mounted within the housing means, the access means is located in the top of the apparatus, providing a top-loading facility. However, for the purposes of the further description of the present invention, it will be assumed that said rotatably mounted cylindrical cage is mounted horizontally within said housing means.

Rotation of said rotatably mounted cylindrical cage is effected by use of drive means, which typically comprises electrical drive means, in the form of an electric motor. Operation of said drive means is effected by control means which may be programmed by an operative.

Said rotatably mounted cylindrical cage is of the size which is to be found in most commercially available washing machines and tumble driers, and may have a capacity in the region of 10 to 7000 liters. A typical capacity for a domestic washing machine would be in the region of 30 to 120 liters whilst, for an industrial washer-extractor, capacities anywhere in the range of from 120 to 7000 liters are possible. A typical size in this range is that which is suitable for a 50 kg washload, wherein the drum has a volume of 450 to 650 liters and, in such cases, said cage would generally comprise a cylinder with a diameter in the region of 75 to 120 cm, preferably from 90 to 110 cm, and a length of between 40 and 100 cm, preferably between 60 and 90 cm. Generally, the cage will have 10 liters of volume per kg of washload to be cleaned.

Said apparatus is designed to operate in conjunction with soiled substrates and cleaning media comprising a solid particulate material, which is most preferably in the form of a multiplicity of polymeric particles. These polymeric particles are required to be efficiently circulated to promote effective cleaning and the apparatus, therefore, preferably includes circulation means. Thus, the inner surface of the cylindrical side walls of said rotatably mounted cylindrical cage preferably comprises a multiplicity of spaced apart elongated protrusions affixed essentially perpendicularly to said inner surface. Preferably, said protrusions additionally comprise air amplifiers which are typically driven pneumatically and are adapted so as to promote circulation of a current of air within said cage. Typically said apparatus comprises from 3 to 10, most preferably 4, of said protrusions, which are commonly referred to as lifters.

In operation, agitation is provided by rotation of said rotatably mounted cylindrical cage. However, in preferred embodiments of the invention, there is also provided additional agitating means, in order to facilitate the efficient removal of residual solid particulate material at the conclusion of the cleaning operation. Preferably, said agitating means comprises an air jet.

Said rotatably mounted cylindrical cage is located within a first upper chamber of said housing means and beneath said first upper chamber is located a second lower chamber which functions as a collection chamber for said cleaning media. Preferably, said lower chamber comprises an enlarged sump.

Said housing means is connected to standard plumbing features, thereby providing at least one recirculation means, in addition to a multiplicity of delivery means, by virtue of which at least water and, optionally, cleaning agents such as surfactants may be introduced into the apparatus. Said apparatus may additionally comprise means for circulating air within said housing means, and for adjusting the temperature and humidity therein. Said means may typically include, for example, a recirculating fan, an air heater, a water atomiser and/or a steam generator. Additionally, sensing means may also be provided for determining, inter alia, the temperature and humidity levels within the apparatus, and for communicating this information to the control means.

Thus, said apparatus comprises at least one recirculation means, thereby facilitating recirculation of said solid particulate material from said lower chamber to said rotatably mounted cylindrical cage, for re-use in cleaning operations. Preferably, said first recirculation means comprises ducting connecting said second chamber and said rotatably mounted cylindrical cage. More preferably, said ducting comprises separating means for separating said solid particulate material from water and control means, adapted to control entry of said solid particulate material into said cylindrical cage. Typically, said separating means comprises a filter material such as wire mesh located in a receptor vessel above said cylindrical cage, and said control means comprises a valve located in feeder means, preferably in the form of a feed tube attached to said receptor vessel, and connected to the interior of the cylindrical cage.

Recirculation of solid particulate matter from said lower chamber to said rotatably mounted cylindrical cage is achieved by the use of pumping means comprised in said first recirculation means, wherein said pumping means are adapted to deliver said solid particulate matter to said separating means and said control means, adapted to control the re-entry of said solid particulate matter into said rotatably mounted cylindrical cage.

Preferably, said apparatus additionally includes a second recirculation means, allowing for the return of water separated by said separating means to said lower chamber, thereby facilitating re-use of said water in an environmentally beneficial manner.

Preferably, said lower chamber comprises additional pumping means to promote circulation and mixing of the contents thereof, in addition to heating means, allowing the contents to be raised to a preferred temperature of operation.

In operation, during a typical cycle, soiled garments are first placed into said rotatably mounted cylindrical cage. Then, the solid particulate material and the necessary amount of water, together with any required additional cleaning agent, are added to said rotatably mounted cylindrical cage. Optionally, said materials are heated to the desired temperature in the lower chamber comprised in the housing means and introduced, via the first recirculation means, into the cylindrical cage. Alternatively, said cleaning agent may, for example, be pre-mixed with water and added either via an addition port mounted on the access means or through said separating means located above said cylindrical cage. Optionally, this water may be heated. Additional cleaning agents, of which bleach is a typical example, may be added with more, optionally heated, water at later stages during the wash cycle, using the same means.

During the course of agitation by rotation of the cage, the fluids and a quantity of the solid particulate material fall through the perforations in the cage and into the lower chamber of the apparatus. Thereafter, the solid particulate material may be re circulated via the first recirculation means such that it is transferred to said separating means, from which it is returned, in a manner controlled by said control means, to the cylindrical cage for continuation of the washing operation. This process of continuous circulation of the solid particulate material continuous throughout the washing operation until cleaning is completed.

Thus, the solid particulate material which falls through the perforations in the walls of said rotatably mounted cylindrical cage and into said lower chamber is carried to the top side of said rotatably mounted cylindrical cage, wherein it is caused, by means of gravity, to fall through said separation means and, by operation of control means, through said feeder means and back into said cage, thereby to continue the cleaning operation.

According to a second aspect of the present invention, there is provided a method for cleaning a soiled substrate, said method comprising the treatment of the substrate with a formulation comprising solid particulate cleaning material and wash water, wherein said method is carried out in an apparatus according to the first aspect of the invention.

Preferably, said method comprises the steps of:

(a) introducing a solid particulate cleaning material and water into the second lower chamber of an apparatus according to the first aspect of the invention;
(b) agitating and heating said solid particulate cleaning material and water;
(c) loading at least one soiled substrate into said rotatably mounted cylindrical cage via access means;
(d) closing the access means so as to provide a substantially sealed system;
(e) introducing said solid particulate cleaning material and water into said rotatably mounted cylindrical cage via recirculating means;
(f) operating the apparatus for a wash cycle, wherein said rotatably mounted cylindrical is caused to rotate and wherein fluids and solid particulate cleaning material are caused to fall through perforations in said rotatably mounted cylindrical cage into said second lower chamber in a controlled manner;
(g) operating pumping means so as to transfer fresh solid particulate cleaning material and recycle used solid particulate cleaning material to separating means;
(h) operating control means so as to add said fresh and recycled solid particulate cleaning material to said rotatably mounted cylindrical cage in a controlled manner; and (i) continuing with steps (f), (g) and (h) as required to effect cleaning of the soiled substrate.

Preferably, additional cleaning agents are employed in said method. Said additional cleaning agents may be added to the lower chamber of said apparatus with said solid particulate cleaning material, optionally heated to the desired temperature therein and introduced, via the first recirculation means, into the cylindrical cage. Preferably, however, said additional cleaning agents are pre-mixed with water, which mixture may optionally be heated before addition to said cylindrical cage via an addition port mounted on the access door. Optionally, this addition may be carried out using a spray head in order to better distribute said cleaning agents in the washload. Alternatively, said addition of cleaning agents may be made via the separating means located above said cage.

Preferably, pumping of said fresh and recycled solid particulate cleaning material proceeds at a rate sufficient to maintain approximately the same level of cleaning material in said rotatably mounted cylindrical cage throughout the cleaning operation, and to ensure that the ratio of cleaning material to soiled substrate stays substantially constant until the wash cycle has been completed.

The generation of suitable G forces, in combination with the action of the solid particulate cleaning material, is a key factor in achieving an appropriate level of cleaning of the soiled substrate. G is a function of the cage size and the speed of rotation of the cage and, specifically, is the ratio of the centripetal force generated at the inner surface of the cage to the static weight of the washload. Thus, for a cage of inner radius r (m), rotating at R (rpm), with a washload of mass M (kg), and an instantaneous tangential velocity of the cage v (m/s), and taking g as the acceleration due to gravity at 9.81 $m/s^2$:

$$\text{Centripetal force}=Mv^2/r$$

$$\text{Washload static weight}=Mg$$

$$v=2\pi rR/60$$

$$\text{Hence, } G=4\pi^2r^2R^2/3600\ rg=4\pi r^2rR^2/3600\ g=1.18\times 10^{-3}rR^2$$

When, as is usually the case, r is expressed in centimeters, rather than meters, then:

$$G=1.118\times10^{-5}rR^2$$

Hence, for a drum of radius 49 cm rotating at 800 rpm, G=350.6.

In a preferred embodiment of the invention, a cylindrical drum having a diameter of 98 cm is rotated at a speed of 30-800 rpm in order to generate G forces of 0.49-350.6 at different stages during the cleaning process. In examples of alternative embodiments of the invention, a 48 cm diameter drum rotating at 1600 rpm can generate 687 G, whilst a 60 cm diameter drum at the same speed of rotation generates 859 G.

In preferred embodiments of the invention, the claimed method additionally provides for separation and recovery of the solid particulate cleaning material, and this may then be re-used in subsequent washes.

During the wash cycle, rotation of said rotatably mounted cylindrical cage is preferably caused to occur at rotation speeds such that G is <1 which, for a 98 cm diameter cage, requires a rotation speed of up to 42 rpm, with preferred rates of rotation being between 30 and 40 rpm.

On completion of the wash cycle, feeding of solid particulate cleaning material into the rotatably mounted cylindrical cage ceases and the speed of rotation of the cage is initially increased in order to effect a measure of drying of the cleaned substrate, thereby generating G forces of between 10 and 1000, more specifically between 40 and 400. Typically, for a 98 cm diameter cage, rotation is at a speed of up to 800 rpm in order to achieve this effect. Subsequently, rotation speed is reduced and returned to the speed of the wash cycle so as to allow for removal of the solid particulate cleaning material.

Optionally, following said bead removal operation, said method may additionally comprise a rinsing operation, wherein additional water may be added to said rotatably mounted cylindrical cage in order to effect complete removal of any additional cleaning agent employed in the cleaning operation. Water may be added to said cylindrical cage via said addition port mounted on said access door. Again, addition may optionally be carried out by means of a spray head in order to achieve better distribution of the rinsing water in the washload. Alternatively, said addition may be via the separating means, or by overfilling the second, lower chamber of said apparatus with water such that it enters the first, upper chamber and thereby partially submerges said rotatably mounted cylindrical cage and enters into said cage. Following rotation at the same speed as during the wash cycle, water is removed from said cage by allowing the water level to fall as appropriate and, whatever method of rinse water addition is employed, the speed of rotation of the cage is then increased so as to achieve a measure of drying of the substrate. Typically, for a 98 cm diameter cage, rotation is at a speed of up to 800 rpm in order to achieve this effect. Subsequently, rotation speed is reduced and returned to the speed of the wash cycle, thereby allowing for final removal of any remaining solid particulate cleaning material. Said rinsing and drying cycles may be repeated as often as desired.

Optionally, said rinse cycle may be used for the purposes of substrate treatment, involving the addition of treatment agents such as anti-redeposition additives, optical brighteners, perfumes, softeners and starch to the rinse water.

Said solid particulate cleaning material is preferably subjected to a cleaning operation in said lower chamber by sluicing said chamber with clean water in the presence or absence of a cleaning agent, such as a surfactant. Optionally, this water may be heated. Alternatively, cleaning of the solid particulate cleaning material may be achieved as a separate stage in said rotatably mounted cylindrical cage, again using water which may optionally be heated.

Generally, any remaining solid particulate cleaning material on said at least one substrate may be easily removed by shaking the at least one substrate. If necessary, however, further remaining solid particulate cleaning material may be removed by suction means, preferably comprising a vacuum wand.

BRIEF DESCRIPTION OF THE DRAWINGS

The invention will now be further illustrated by reference to the following drawings, wherein.

DETAILED DESCRIPTION OF THE INVENTION

Figures 1A, 1B:
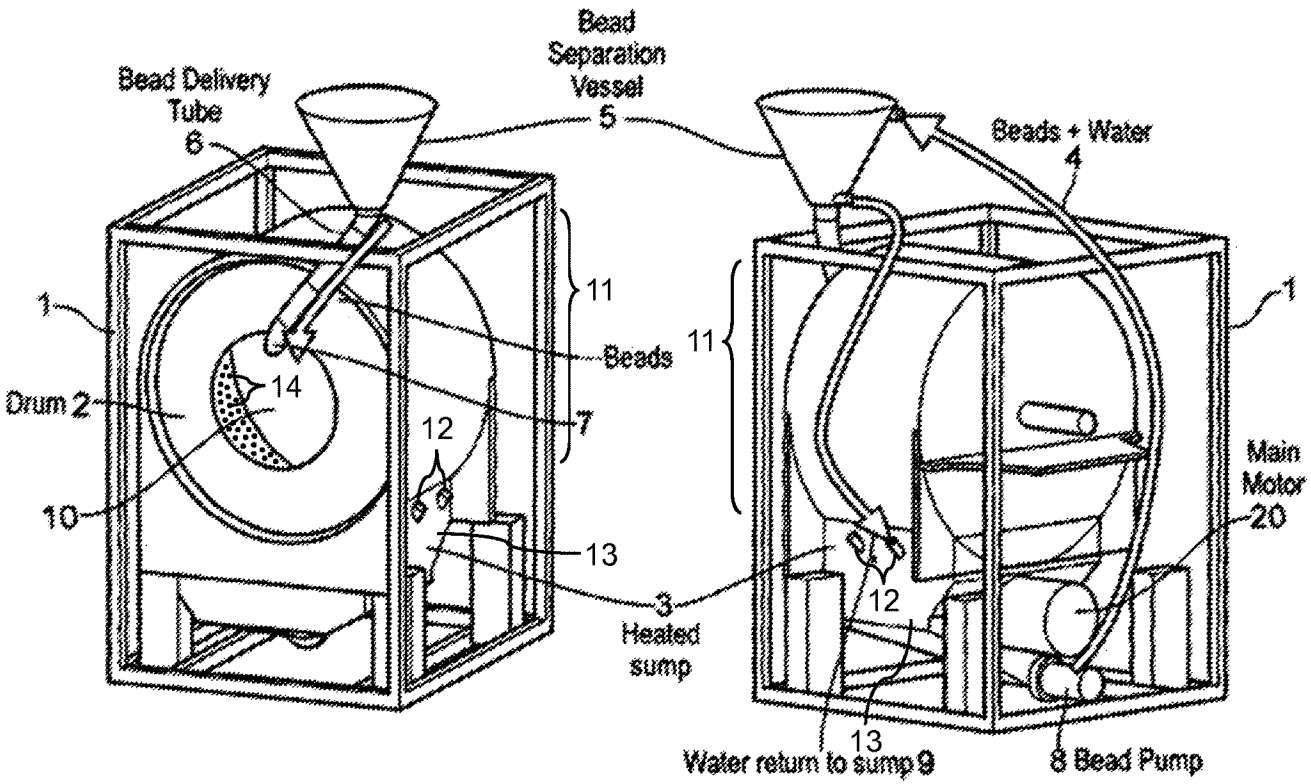
FIGS. 1(*a*) and (*b*) show an apparatus according to the invention, and illustrate aspects of the recirculation means of the apparatus.

The apparatus according to the invention may be used for the cleaning of any of a wide range of substrates including, for example, plastics materials, leather, paper, cardboard, metal, glass or wood. In practice, however, said apparatus is principally designed for use in the cleaning of substrates comprising textile fibre garments, and has been shown to be particularly successful in achieving efficient cleaning of textile fibres which may, for example, comprise either natural fibres, such as cotton, or man-made and synthetic textile fibres, for example nylon 6,6, polyester, cellulose acetate, or fibre blends thereof.

Most preferably, the solid particulate cleaning material comprises a multiplicity of polymeric particles. Typically, the polymeric particles comprise polyalkenes such as polyethylene and polypropylene, polyamides, polyesters or polyurethanes, which may be foamed or unfoamed. Furthermore, said polymers may be linear or crosslinked.

Preferably, however, said polymeric particles comprise polyamide or polyester particles, most particularly particles of nylon, polyethylene terephthalate or polybutylene terephthalate, most preferably in the form of beads. Said polyamides and polyesters are found to be particularly effective for aqueous stain/soil removal, whilst polyalkenes are especially useful for the removal of oil-based stains.

Various nylon or polyester homo- or co-polymers may be used including, but not limited to, Nylon 6, Nylon 6,6, polyethylene terephthalate and polybutylene terephthalate. Preferably, the nylon comprises Nylon 6,6 homopolymer having a molecular weight in the region of from 5000 to 30000 Daltons, preferably from 10000 to 20000 Daltons, most preferably from 15000 to 16000 Daltons. The polyester will typically have a molecular weight corresponding to an intrinsic viscosity measurement in the range of from 0.3-1.5 dl/g as measured by a solution technique such as ASTM D-4603.

Optionally, copolymers of the above polymeric materials may be employed for the purposes of the invention. Specifically, the properties of the polymeric materials may be tailored to specific requirements by the inclusion of monomeric units which confer particular properties on the copolymer. Thus, the copolymers may be adapted to attract particular staining materials by including monomer units in the polymer chain which, inter alia, are ionically charged, or include polar moieties or unsaturated organic groups. Examples of such groups may include, for example, acid or amino groups, or salts thereof, or pendant alkenyl groups.

The polymeric particles are of such a shape and size as to allow for good flowability and intimate contact with the textile fibre. A variety of shapes of particles can be used, such as cylindrical, spherical or cuboid; appropriate cross-sectional shapes can be employed including, for example, annular ring, dog-bone and circular. Most preferably, however, said particles comprise cylindrical or spherical beads.

The particles may have smooth or irregular surface structures and can be of solid or hollow construction. Particles are of such a size as to have an average mass of 1-35 mg, preferably from 10-30 mg, more preferably from 12-25 mg, and with a surface area of 10-120 $mm^2$, preferably from 15-50 $mm^2$, more preferably from 20-40 $mm^2$.

In the case of cylindrical beads, the preferred particle diameter is in the region of from 1.0 to 6.0 mm, more preferably from 1.5 to 4.0 mm, most preferably from 2.0 to 3.0 mm, and the length of the beads is preferably in the range from 1.0 to 4.0 mm, more preferably from 1.5 to 3.5 mm, and is most preferably in the region of 2.0 to 3.0 mm.

Typically, for spherical beads, the preferred diameter of the sphere is in the region of from 1.0 to 6.0 mm, more preferably from 2.0 to 4.5 mm, most preferably from 2.5 to 3.5 mm.

In order to provide additional lubrication to the cleaning system and thereby improve the transport properties within the system, water is added to the system. Thus, more efficient transfer of the at least one cleaning material to the substrate is facilitated, and removal of soiling and stains from the substrate occurs more readily. Optionally, the soiled substrate may be moistened by wetting with mains or tap water prior to loading into the apparatus of the invention. In any event, water is added to the rotatably mounted cylindrical cage of the apparatus according to the invention such that the washing treatment is carried out so as to achieve a water to substrate ratio which is preferably between 2.5:1 and 0.1:1 w/w; more preferably, the ratio is between 2.0:1 and 0.8:1, with particularly favourable results having been achieved at ratios such as 1.75:1, 1.5:1, 1.2:1 and 1.1:1. Most conveniently, the required amount of water is introduced into the rotatably mounted cylindrical cage of the apparatus according to the invention after loading of the soiled substrate into said cage. An additional amount of water will migrate into the cage during the circulation of the solid particulate cleaning material, but the amount of carry over is minimised by the action of the separating means.

Whilst, in one embodiment, the method of the invention envisages the cleaning of a soiled substrate by the treatment of a moistened substrate with a formulation which essentially consists only of a multiplicity of polymeric particles, in the absence of any further additives, optionally in other embodiments the formulation employed may additionally comprise at least one cleaning agent. Said at least one cleaning agent may include at least one cleaning material. Preferably, the at least one cleaning material comprises at least one detergent composition. Optionally, said at least one cleaning material is mixed with said polymeric particles but, in a preferred embodiment, each of said polymeric particles is coated with said at least one cleaning material.

The principal components of the detergent composition comprise cleaning components and post-treatment components. Typically, the cleaning components comprise surfactants, enzymes and bleach, whilst the post-treatment components include, for example, anti-redeposition additives, perfumes and optical brighteners.

However, the detergent formulation may optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants may be selected from non-ionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

The compositions may include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination may comprise a mixture of enzymes such as protease, lipase, cutinase and/or cellulase in conjunction with amylase.

Optionally, enzyme stabilisers may also be included amongst the cleaning components. In this regard, enzymes for use in detergents may be stabilised by various techniques, for example by the incorporation of water-soluble sources of calcium and/or magnesium ions in the compositions.

The compositions may include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders may be included in the formulations and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The compositions may also optionally contain one or more copper, iron and/or manganese chelating agents and/or one or more dye transfer inhibiting agents.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent formulations can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives are physico-chemical in their action and include, for example, materials such as polyethylene glycol, polyacrylates and carboxy methyl cellulose.

Optionally, the compositions may also contain perfumes Suitable perfumes are generally multi-component organic chemical formulations which can contain alcohols, ketones, aldehydes, esters, ethers and nitrile alkenes, and mixtures thereof.

Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

Suitable optical brighteners fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

Said agents may be used either alone or in any desired combination and may be added to the cleaning system at appropriate stages during the cleaning cycle in order to maximise their effects.

In any event, however, when the method of the invention is performed in the presence of at least one additional cleaning agent, the quantity of said cleaning agent required in order to achieve satisfactory cleaning performance is significantly reduced from the quantities required with the methods of the prior art. This, in turn, has beneficial effects in terms of the reduced quantity of rinse water that is subsequently required to be used.

The ratio of solid particulate cleaning material to substrate is generally in the range of from 0.1:1 to 10:1 w/w, preferably in the region of from 0.5:1 to 5:1 w/w, with particularly favourable results being achieved with a ratio of between 1:1 and 3:1 w/w, and especially at around 2:1 w/w. Thus, for example, for the cleaning of 5 g of fabric, 10 g of polymeric particles, optionally coated with surfactant, would be employed in one embodiment of the invention. The ratio of solid particulate cleaning material to substrate is maintained at a substantially constant level throughout the wash cycle.

The apparatus and the method of the present invention may be used for either small or large scale batchwise processes and find application in both domestic and industrial cleaning processes.

As previously noted, the method of the invention finds particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated according to the method of the invention at, for example, temperatures of between 5 and 95° C. for a duration of between 5 and 120 minutes in a substantially sealed system. Thereafter, additional time is required for the completion of the rinsing and bead separation stages of the overall process, so that the total duration of the entire cycle is typically in the region of 1 hour. The preferred operating temperatures for the method of the invention are in the range of from 10 to 60° C. and, more preferably, from 15 to 40° C.

The cycle for removal of solid particulate material may optionally be performed at room temperature and it has been established that optimum results are achieved at cycle times of between 2 and 30 minutes, preferably between 5 and 20 minutes.

The results obtained are very much in line with those observed when carrying out conventional wet (or dry) cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The energy requirement, the total volume of water used, and the detergent consumption of the method of the invention are all significantly lower than those levels associated with the use of conventional aqueous washing procedures, again offering significant advantages in terms of cost and environmental benefits.

Additionally, it has been demonstrated that re-utilisation of the polymer particles is possible, allowing for the performance of multiple washes with the same solid particulate cleaning material. Re-use of the particles in this way for repeat cleaning procedures provides significant economic benefits and the achievement of satisfactory results after multiple washes is assisted by the nature of the process, which relies on continuous cleaning of the particulate cleaning material as an integral part of the procedure, although it generally found that some deterioration in performance is eventually observed.

In a typical example of an operating cycle according to the method of the invention, an initial addition of solid particulate cleaning material (approximately 43 kg) is added to a washload of soiled substrate (15 kg) in the rotatably mounted cylindrical cage of 98 cm diameter, after which rotation of the cage commences at around 40 rpm. Thereafter, further solid particulate cleaning material (10 kg) is pumped into said rotatably mounted cylindrical cage via the separating means and control means approximately every 30 seconds throughout the duration of the wash cycle which may typically continue for around 30 minutes. The system is thereby designed to pump and add solid particulate cleaning material at a sufficient rate to maintain roughly the same level of solid particulate cleaning material in the rotatably mounted cylindrical cage (approximately 2.9:1 by weight, for 43 kg of beads and 15 kg of cloth) throughout the wash.

Thus, during the wash cycle, the solid particulate cleaning material is continually falling out of the rotatably mounted cylindrical cage through its perforations, and is being recycled and added, together with fresh cleaning material, via the separating means and control means. This process may either be controlled manually, or operated automatically. The rate of exit of the solid particulate cleaning material from the rotatably mounted cylindrical cage is essentially controlled by means of its specific design. The key parameters in this regard include the size of the perforations, the number of perforations and the pattern of the perforations.

Generally, the perforations are sized at around 2-3 times the average particle diameter of the solid particulate cleaning material which, in a typical example, results in perforations having a diameter of no greater than 10.0 mm.

In a preferred embodiment of the invention, a rotatably mounted cylindrical cage (diameter 98 cm, depth 65 cm) would be drilled to have stripes of 8.0 mm diameter perforations running from front to back in approximately 9 cm wide strips alternating with solid sections, so that only around 34% of the surface area of the cylindrical walls of the cage comprises perforations. The perforations are preferably banded in stripes on the cylindrical walls of the rotatably mounted cylindrical cage or, alternatively, uniformly distributed over the cage wall, rather than being exclusively located, for example, in one half of the cage.

The rate of exit of the solid particulate cleaning material from the rotatably mounted cylindrical cage is also affected by the speed of rotation of said cage, with higher rotation speeds increasing the centripetal force so as to increase the tendency to push the solid particulate cleaning material out of the perforations. However, higher cage rpm values also compress the substrate being cleaned, so as to trap the cleaning material within folds thereof. The most suitable rotation speeds are, therefore, generally found to be between 30 and 40 rpm at 98 cm cage diameter, or those which generate G values of between 0.49 and 0.88. The maximum rotation speed in order to avoid bead trapping in garments is found to be around 42 rpm (G=0.97).

In addition, the moisture level in the wash also has an effect, with wetter substrates tending to retain cleaning material for a longer time than drier substrates. Consequently, overwetting of substrate can, if necessary, be employed in order to further control the rate of exit of solid particulate cleaning material.

On completion of the wash cycle, addition of solid particulate cleaning material to the rotatably mounted cylindrical cage is ceased, and the cage is rotated for a short time (about 2 minutes) at low rpm (30-40 rpm; G=0.49-0.88) to allow the bulk of the solid particulate cleaning material to leave the cage. The cage is then rotated at high speed (between 300 and 800 rpm; G=49.3-350.6) for about 2 minutes in order to extract some liquid and dry the substrate to an extent. The rotation speed is then returned to the same low rpm as in the wash cycle in order to complete the removal of cleaning material; this generally takes around 20 minutes.

The method of the invention has been shown to be particularly successful in the removal of cleaning material from the cleaned substrate after washing, and tests with cylindrical polyester beads, and nylon beads comprising Nylon 6,6 polymer, have indicated bead removal efficacy such that on average <20 beads per garment remain in the washload at the end of the bead separation cycle. Generally, this can be further reduced to an average of <10 beads per garment and, in optimised cases wherein a 20 minute separation cycle is employed, an average of <5 beads per garment is typically achieved.

Following said bead removal operation a series of rinses is carried out, wherein additional water is sprayed into the rotatably mounted cylindrical cage in order to effect complete removal of any additional cleaning agent employed in the cleaning operation. In this embodiment of the invention, a spray head is used, which is mounted in an addition port on the access door. The use of said spray head has been shown to better distribute the rinsing water in the washload. By this means the overall water consumption during the rinsing operation can also be minimised (3:1 rinse water: cloth, typically, per rinse). The cage is rotated at low speeds again during rinse water addition (30-40 rpm, G=0.49-0.88 for 98 cm diameter cage), but after this operation has ceased the cage speed is once again increased to achieve a measure of drying of the substrate (300-800 rpm, G=49.3-350.6). Subsequently, rotation speed is reduced and returned to the speed of the wash cycle so as to allow for final removal of any remaining solid particulate cleaning material. Said rinsing and drying cycles may be repeated as often as desired (3 times is typical).

Referring to the figures provided herewith, there is seen in FIGS. 1(*a*) and (*b*) an apparatus according to the invention comprising housing means (1) having a first upper chamber (11) having mounted therein a rotatably mounted cylindrical cage in the form of drum (2) with perforations (14), as one example, shown within drum (2) and a second lower chamber comprising sump (3) located beneath said cylindrical cage. The apparatus additionally comprises, as first recirculation means, bead and water riser pipe (4) which feeds into a bead separation vessel (5), including filter material, typically in the form of a wire mesh, and a bead release gate valve which feeds into bead delivery tube (6) mounted in cage entry (7). The first recirculation means is driven by a bead pump (8). Additional recirculation means comprises return water pipe (9), which allows water to return from the bead separation vessel (5) to the sump (3) under the influence of gravity. The apparatus also comprises access means shown as loading door (10), through which material for cleaning may be loaded into drum (2). A delivery means (12) is shown, as an example, for delivery of water and optionally cleaning agents into the apparatus. Additional pumping means (13) are typically located within sump (3) to promote circulation and mixing of the contents.

Thus, FIG. 1(*a*) illustrates a section of the first recirculation system, wherein the solid particulate cleaning material in the form of beads passes from the bead separation vessel (5) through the bead delivery tube (6) and into the drum (2), and FIG. 1(*b*) shows other sections of the first recirculation system, wherein the solid particulate cleaning material comprising beads and water is driven by bead pump (8) from the heated sump (3) through the bead and water riser pipe (4) to the bead separation vessel (5), from which separated water returns to the sump via return water pipe (9) under the influence of gravity. The main motor (20) of the apparatus, responsible for driving the drum (2), is also depicted.

In operation, the sump (3), together with its contents (water and polymer beads) may be heated by heater pads attached to the outer surface of the sump (3). The bead pump (8) pumps the beads and water up through the riser pipe (4) to the bead separation vessel (5) where the beads are retained within the vessel (5) whilst the drained water returns to the sump via a return pipe (9). The rigid filter material within the separation vessel allows the water carried with the beads to escape from within the mass of the beads, whilst the gate valve retains the beads within the vessel (5). Further beads may then be pumped into the separation vessel (5). The water drains from the vessel (5) and returns to the sump (3). When the valve in vessel (5) is opened, the beads pass through the valve and travel down the bead delivery tube (6), through the cage entry (7) and in to the drum (2). Cold water may be added to the contents of the drum (2) via a cold water feed port located in cage entry (7). The wash load is placed into the drum (2) through openable loading door (10), and detergent is added to the system via a port in the sump (3). The system temperature is monitored via a temperature probe, preferably mounted in bead delivery tube (6), whilst a water pump circulates water around the sump (3).

Hence, the system provides a means of adding polymer beads to a wash load, performing the washing cycle, and then separating the beads from the wash load once the washing cycle is complete. The washing process may be conveniently illustrated by describing one complete wash cycle.

Thus, polymer beads together with the required addition of water to achieve efficient pumping are optionally heated to operating temperature in the sump (3) by the sump heater pads, and the water is recirculated through the beads using the water pump to ensure that a uniform bulk temperature is achieved. Once the required operating temperature is achieved, the wash load is placed into the drum (2) and the loading door (10) is closed. Initially, cold water is added to the wash load via the cold water feed port to ensure that any stains (such as egg) are not 'baked' on to the fabric when the warm wash water and beads are introduced. Cleaning materials such as detergents may be added to the polymer beads in the sump, but are preferably added at this stage, with water; said addition may be made either via an addition port (not shown) mounted on the door (10) or through the bead separation vessel (5) and bead delivery tube (6). The wash load is agitated gently to disperse the cold water evenly amongst the load and fully wet out the cloth. Additional cleaning materials, of which bleach is a typical example, may be added with more, optionally heated, water at later stages during the wash cycle via the same means of addition.

Once the initial working temperature has been reached by the beads and water within the sump, the bead pump (8) pumps a mixture of beads and water up to the bead separation vessel (5). Excess water is allowed to drain back to the sump (3) and the valve is then opened to release the beads into the drum (2) via the bead delivery tube (6). This operation is repeated a number of times until the required quantity of beads has been delivered to the drum (2).

The system then performs a wash cycle in a similar manner to a standard washing machine with the cage rotating at between 30 and 40 rpm (G=0.49-0.88 for a 98 cm cylindrical cage) for several revolutions in one direction, then rotating a similar number of rotations in the opposite direction. This sequence is repeated for up to 60 minutes. During this time, the beads are continually falling though the cage perforations into the sump (3) and being pumped back by the bead pump (8) to the bead separation vessel (5) from which, together with fresh beads as necessary, they are re-introduced into the drum (2).

On completion of the wash cycle, introduction of beads into drum (2) ceases whilst the beads remain free to fall through the cage perforations and out into the sump (3). Following a short high speed rotation to remove some liquor from the drum and partially dry out the cleaned substrate, a series of slow speed rotations and counter rotations is performed to encourage the beads to fall through the perforations in the drum (2) and return to the sump (3). This process is continued until virtually all of the beads have been removed from within the drum (2). At any point during this bead separation sequence, air can be blown into the drum to disrupt and cause the billowing of the cloth to aid bead removal. The wash load can then be removed from the drum (2) via the loading door (10).

In a preferred bead removal sequence, the drum (2) is initially rotated for 2 minutes at between 300 and 800 rpm (G=49.3-350.6 for a 98 cm diameter drum), then for 20 minutes at between 30 and 40 rpm, during which time the direction of rotation is reversed approximately every 30 seconds in order to re-orientate the substrate and allow the beads to fall from the substrate, thereby effecting efficient bead removal.

In a separate optional step, the wash load may be rinsed with water following the wash cycle. In further optional stages, following their removal from the drum and transfer to the sump, the beads may be cleaned by sluicing the sump with clean water in the presence or absence of a cleaning agent, such as a surfactant. Alternatively, cleaning of the beads may be carried out by washing them alone in the drum following removal of the wash load.

The invention will now be further illustrated, though without in any way limiting the scope thereof, by reference to the following examples and associated illustrations.

EXAMPLES

Example 1

Woven cotton fabric (194 $gm^{-2}$, Whaleys, Bradford, U.K.) was stained with coffee, lipstick, ball point pen, tomato ketchup, boot polish, grass, vacuum dirt, curry sauce and red wine following the methods described below:

(i) Coffee 10 g of Morrisons® Full Roast coffee powder was dissolved in 50 ml distilled water at 70° C. A 1 $cm^3$ aliquot of the ensuing solution was applied to the fabric using a synthetic sponge, within the confines of a 5 cm diameter circular plastic template; the stained fabric was then allowed to dry at ambient temperature (23° C.), after which the fabric was aged prior to use, by storage in the dark for 4 days.

(ii) Lipstick

Revlon® Super Lustrous lipstick (copper frost shade) was applied to the fabric using a synthetic sponge to provide a uniform coverage within the confines of a 5 cm diameter circular plastic template. The fabric was then aged following the procedure recounted for coffee.

(iii) Ball Point Pen

A black Paper Mate® Flex Grip Ultra ball point pen was used to uniformly cover the fabric within the confines of a 5 cm diameter circular plastic template. The fabric was then aged following the procedure recounted for coffee.

(iv) Tomato Ketchup

Heinz® tomato ketchup was applied to the fabric using a synthetic sponge to provide a uniform coverage within the confines of a 5 cm diameter circular plastic template. The fabric was then aged following the procedure recounted for coffee.

(v) Boot Polish

Kiwi® black boot polish was applied to the fabric using a synthetic sponge to provide a uniform coverage within the confines of a 5 cm diameter circular plastic template. The fabric was then aged following the procedure recounted for coffee.

(vi) Grass

Grass was collected manually from an MG7 (National Vegetation Classification) source. 10 g of the grass was chopped with scissors and blended with 200 ml of tap water using an electronic blender. The mixture was then filtered using a metal sieve, and the filtrate used as the staining medium. This was applied to the fabric using a synthetic sponge to provide a uniform coverage within the confines of a 5 cm diameter circular plastic template. The fabric was then aged following the procedure recounted for coffee.

(vii) Vacuum Dirt

Vacuum dirt was collected manually from a general domestic vacuum bag. 25 g of vacuum dirt was mixed with 100 ml of tap water, and the mixture used to stain the fabric. This was applied to the fabric using a synthetic sponge to provide a uniform coverage within the confines of a 5 cm diameter circular plastic template. The fabric was then aged following the procedure recounted for coffee.

(viii) Curry Sauce

Morrisons® own brand curry sauce was applied directly to the fabric using a synthetic sponge to provide a uniform coverage within the confines of a 5 cm diameter circular plastic template. The fabric was then aged following the procedure recounted for coffee.

(ix) Red Wine

"Spanish Red Wine" purchased at Morrisons® was applied directly to the fabric using a synthetic sponge to provide a uniform coverage within the confines of a 5 cm diameter circular plastic template. The fabric was then aged following the procedure recounted for coffee.

Figure 2:
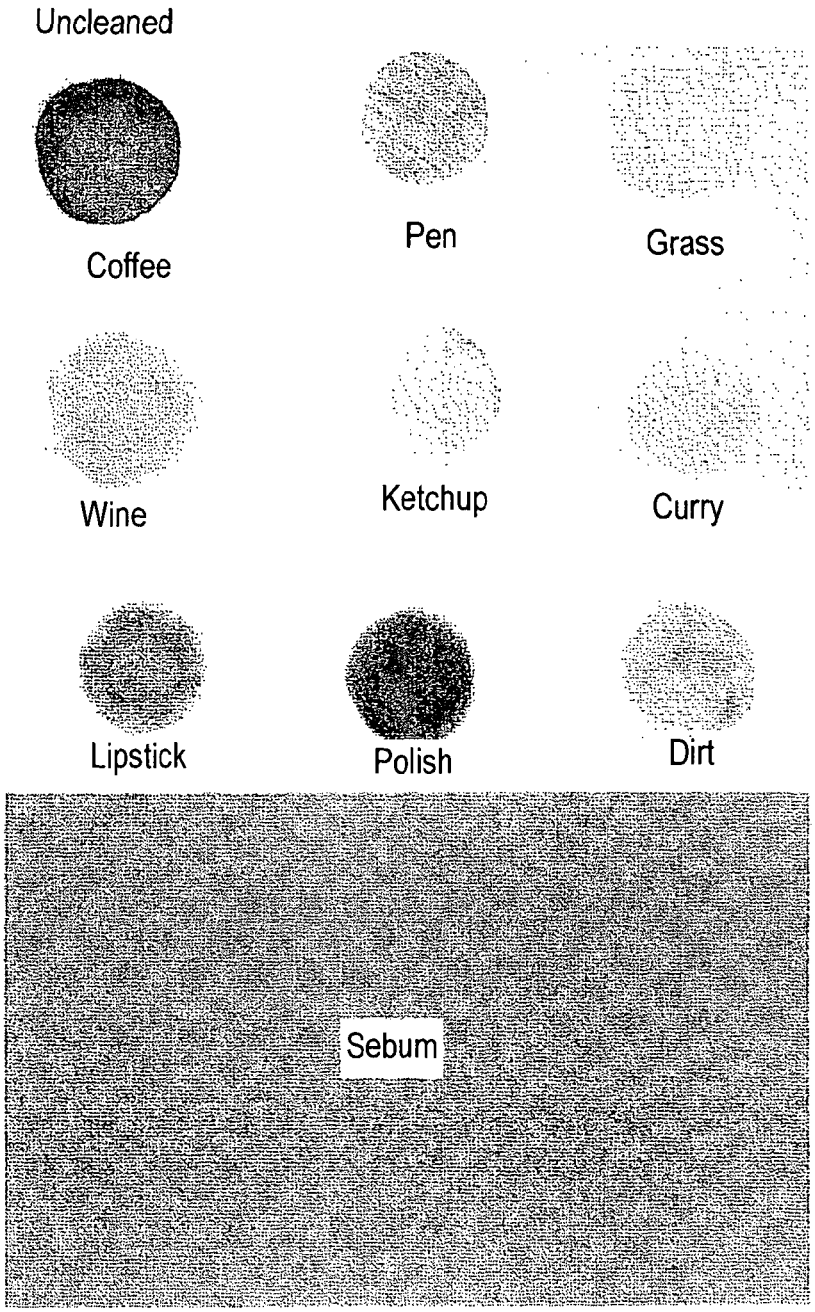
FIG. 2 shows a pattern of stains (i)-(ix) applied to a single piece of cotton fabric in order to make up a standard stain set.
Figure 3:
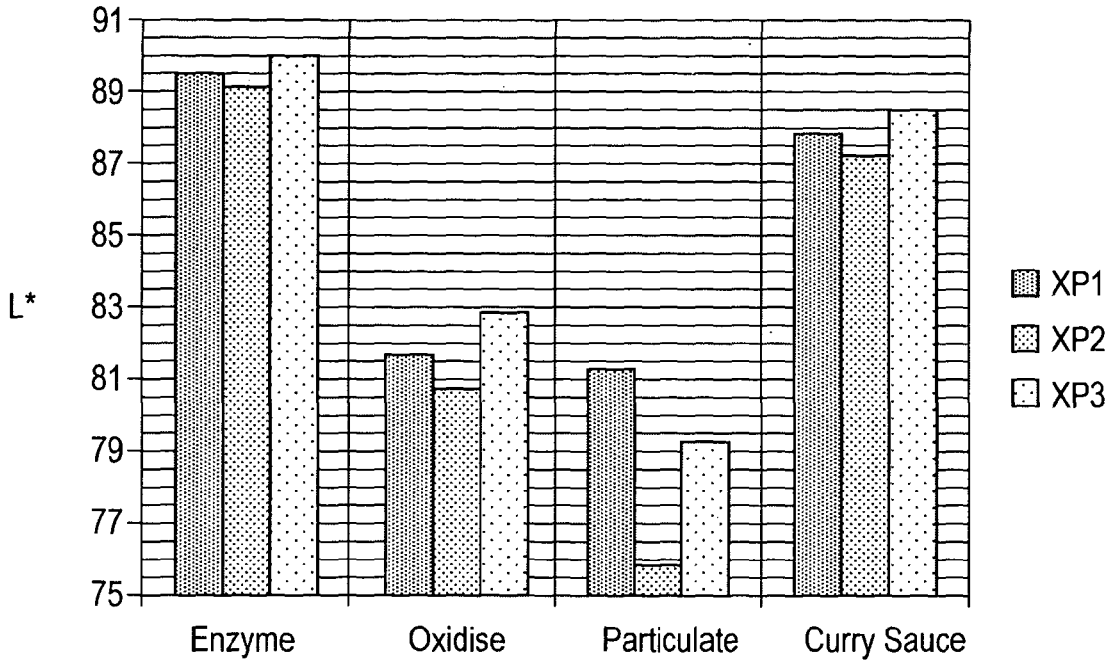
FIG. 3 represents cleaning results by stain type.
Figure 4:
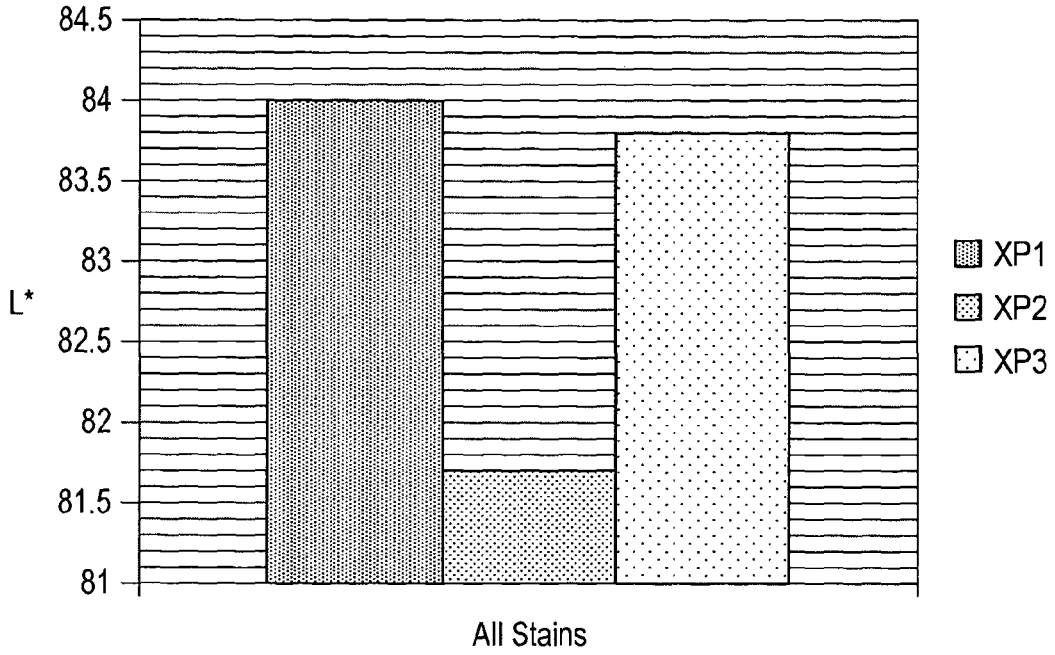
FIG. 4 represents cleaning results by average over all stains.

Each of the stains (i)-(ix) was applied to a single (36 cm×30 cm) piece of cotton fabric in the pattern shown in FIG. 2, in order to make up a standard stain set.

Cleaning trials were then carried out using a set of trial and control conditions, as set out in Table 1. The trials involved the use of a preferred apparatus as hereinbefore defined according to the method of the invention ("Xeros—Gen 1" XP1), whilst control cleaning trials were carried out using a standard domestic washing machine (BEKO® WM5120W, XP2 and XP3). In both cases (XP1, XP2 and XP3) the standard stain sets were added at 1/kg of washload, and a simulated sebum grease stain of 10 g/kg of washload was also incorporated as impregnated cotton cloth (WFK SBL2004). This cloth is used to better simulate the domestic washing environment where such collar and cuff grease is the dominant stain (making up some 80% of the overall stain loading). Sebum is derived from the skin's sebaceous glands. The XP1 process was undertaken at ambient temperature (measured as 15° C.) with a 24 kg cotton and polyester/cotton mixed fabric washload, 28.8 liters of wash water (i.e. 1.2 liters/kg washload) and 65 kg of INVISTA™ 1101 polyester beads (i.e. 2.7 kg/kg washload). A rinse cycle of four 18 liter rinses was employed (spin speed 300 rpm in a 98 cm diameter drum; G=49.3). The total water consumption (including wash and rinse) was, therefore, only 100.8 liters, or 4.2 liters/kg washload. The detergent used was Unilever Persil Small & Mighty® biological liquid at 3.7 g/kg of washload. The total cycle time was 95 minutes.

The domestic controls (XP2 and XP3) were carried out with a 4 kg washload, even though the BEKO® WM5120W is rated as a 5 kg machine. This is the widely accepted average washload size for the European domestic market and it, in turn, makes this control more rigorous. The increased ullage in the drum results in more mechanical action and a better wash performance. It should also be noted that whilst XP2 was run at ambient wash temperature (measured as 15° C.), XP3 was run at a higher wash temperature (40° C.). In addition, both the XP2 and XP3 were run with a 9.3 g/kg washload of detergent, which was considerably more than for XP1, and the water consumption was also higher (wash plus rinse 56 kg, or 14.0 liters/kg of washload). Finally, the total process cycle time for XP2 and XP3 was 127 minutes, which is considerably longer than for XP1, using the process according to the invention. These parameters were a function of the cycle chosen on the BEKO® machine (40° C., cotton), and they also obviously increased the rigour of the control. It should be noted that the BEKO® WM5120W does not have an ambient cycle in its standard programme choices; hence, the ambient cycle was achieved in this instance by disconnecting the heater from the machine and re-running the 40° C. cotton cycle, so that XP3 had the same cycle time as XP2.

The test parameters are summarised in Table 1.

TABLE 1

XP1, XP2 & XP3 Wash Test Details

| Test # | Machine Type | Washload (kg) | Detergent Dosage (g) | Detergent Dosage (g/kg) | Water Consumption (liters/kg) | Wash Temperature (° C.) | Cycle Time (mins) |
|---|---|---|---|---|---|---|---|
| XP1 (Trial) | Xeros - Gen1 | 24 | 89 | 3.7 | 4.2 | 15 | 95 |
| XP2 (Control) | BEKO ® WM5120W | 4 | 37 | 9.3 | 14.0 | 15 | 127 |
| XP3 (Control) | BEKO ® WM5120W | 4 | 37 | 9.3 | 14.0 | 40 | 127 |

The level of cleaning achieved was assessed using colour measurement. Reflectance values of samples were measured using a Datacolor Spectraflash SF600 spectrophotometer interfaced to a personal computer, employing a 10° standard observer, under illuminant $D_{65}$, with the UV component included and specular component excluded; a 3 cm viewing aperture was used. Measurements using a single thickness of fabric were made. The CIE L* colour co-ordinate was taken for each stain and then the average values were recorded as 'Enzyme' (grass and tomato ketchup stain average), 'Oxidise' (coffee, red wine and ball point pen average), and 'Particulate' (vacuum dirt, boot polish and lipstick stain average), with the curry sauce stain being measured individually. The sebum stain removal and level of redeposition on the cloth (i.e. the background whiteness on each stain set) were also measured individually.

Figure 5:
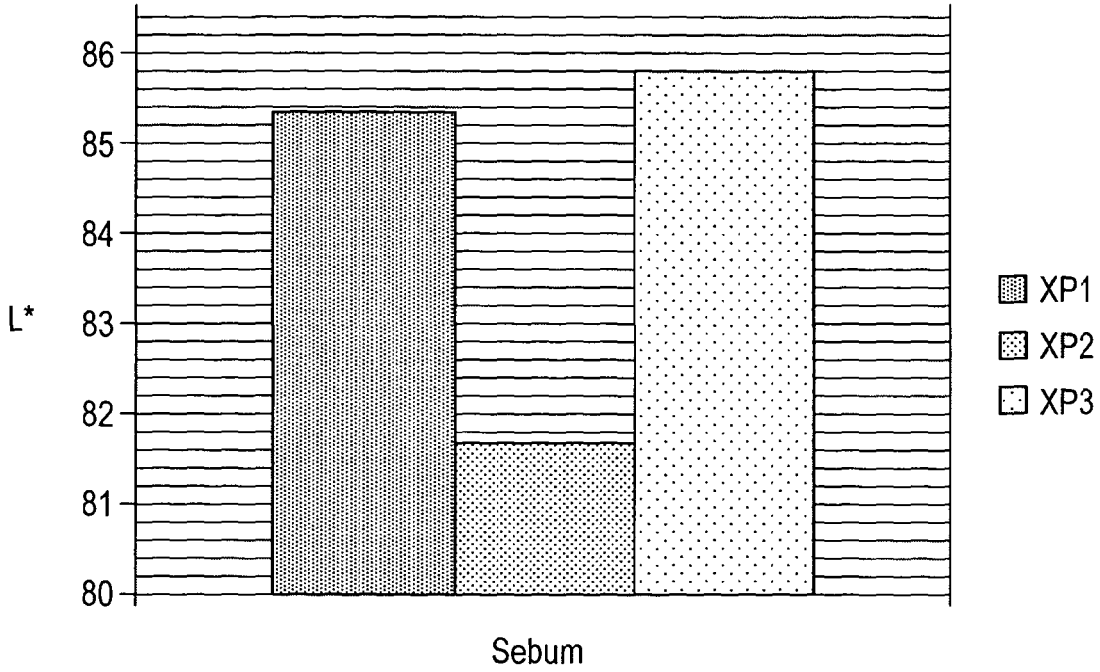
FIG. 5 represents cleaning of sebum results.
Figure 6:
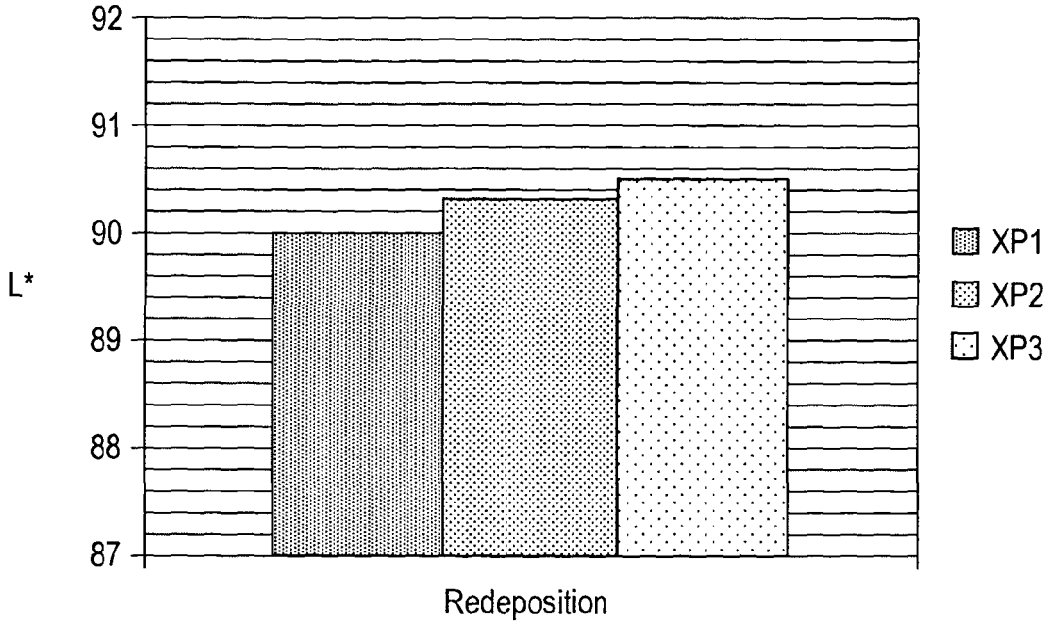
FIG. 6 represents redeposition results.

These results are set out in FIGS. 3 to 6, with higher values indicating better cleaning performance, or redeposition control. Comparison of XP1 with XP2 shows the cleaning carried out in the apparatus of the invention gave superior results for each stain class (FIG. 3), and when averaged over all stains (FIG. 4)—even with the reduced detergent and water levels used in XP1 versus XP2, and despite the longer cycle time of XP2. Sebum removal was significantly better with the method of the invention (FIG. 5), whilst redeposition was similar (FIG. 6).

Comparison of XP1 and XP3 shows the cleaning carried out in the apparatus of the invention gave comparable performance for each stain class (FIG. 3—slightly better with particulate), and when averaged over all stains (FIG. 4)—now even despite the reduced detergent and water levels and significantly lower wash temperature used in XP1 versus XP3, and the longer cycle time of XP3. Sebum removal and redeposition were both similar (FIGS. 5 and 6 respectively).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for use in the cleaning of soiled substrates, said apparatus comprising:

(a) housing means, having:

(i) a first upper chamber having mounted therein a rotatably mounted cylindrical cage, and (ii) a second lower chamber located beneath and fluidly connected to said cylindrical cage, which functions as a collection chamber for cleaning media comprising a solid particulate cleaning material;

(b) at least one recirculation means facilitating recirculation of said solid particulate cleaning material from said second lower chamber to said rotatably mounted cylindrical cage for re-use in cleaning operations, wherein said at least one recirculation means comprises ducting connecting said second lower chamber and said rotatably mounted cylindrical cage, wherein said ducting comprises separating means for separating said solid particulate cleaning material from water, and wherein the ducting comprises a bead delivery tube that allows said solid particulate cleaning material to pass from the separating means into the cylindrical cage;

(c) access means allowing access to the inside of the cylindrical cage for loading at least one soiled substrate into said cylindrical cage, wherein said access means is closable so as to provide a sealed system;

(d) pumping means comprised in a first recirculation means of the at least one recirculation means; and (e) a multiplicity of delivery means for delivery of water and optionally cleaning agents into the apparatus, wherein said rotatably mounted cylindrical cage comprises a drum comprising perforated side walls, wherein up to 60%, of the surface area of said cylindrical side walls comprises perforations, and said perforations comprise holes having a diameter of no greater than 25.0 mm and configured to allow passage of said solid particulate cleaning material;

and wherein said apparatus is for use in the cleaning of the soiled substrates using a formulation comprising said solid particulate cleaning material and wash water.

2. An apparatus as claimed in claim 1 wherein said rotatably mounted cylindrical cage has a capacity of 10 to 7000 liters and optionally comprises a cylinder with a diameter of 75 to 120 cm and a length of between 40 and 100 cm.

3. An apparatus as claimed in claim 1 wherein rotation of said rotatably mounted cylindrical cage is effected by use of drive means, wherein said drive means optionally comprises electrical drive means and said electrical drive means optionally comprises an electric motor.

4. An apparatus as claimed in claim 1 wherein said second lower chamber comprises a sump.

5. An apparatus as claimed in claim 1 wherein said separating means comprises a vessel located above said cylindrical cage.

6. An apparatus as claimed in claim 1 which includes a second recirculation means, wherein said second recirculation means allows for the return of water separated by the separating means to said second lower chamber.

7. An apparatus as claimed in claim 6 wherein said second recirculation means comprises a return water pipe which allows for the return of water separated by the separating means to said second lower chamber.

8. An apparatus as claimed in claim 1 wherein said second lower chamber comprises additional pumping means to promote circulation and mixing of the contents of the second lower chamber.

9. A method for cleaning a soiled substrate, said method comprising the treatment of the substrate with a formulation comprising solid particulate cleaning material and wash water, wherein said method is carried out in an apparatus according to claim 1.

10. A method as claimed in claim 9 which additionally comprises a rinsing operation wherein additional water is added to said rotatably mounted cylindrical cage.

11. A method as claimed in claim 10 wherein substrate treatment agents are added to the rinse water during said rinsing operation, wherein said substrate treatment agents are optionally selected from anti-redeposition additives, optical brighteners, perfumes, softeners and starch.

12. A method as claimed in claim 9 wherein at least one additional cleaning agent is added to said apparatus, wherein said at least one additional cleaning agent is optionally either added to the second lower chamber of said apparatus with said solid particulate cleaning material, heated to the desired temperature therein, and the introduced, via said first recirculation means, into said cylindrical cage, or is pre-mixed with water and added to said cylindrical cage via an addition port mounted on said access means, and wherein said at least one additional cleaning agent optionally comprises at least one detergent composition which optionally comprises cleaning components and post-treatment components, wherein said cleaning components optionally comprise surfactants, enzymes and bleach and said post-treatment components optionally comprise anti-redeposition additives, perfumes and optical brighteners, and which optionally additionally comprises at least one other additive selected from builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and pigments.

13. A method as claimed in claim 9 wherein during the wash cycle, rotation of said rotatably mounted cylindrical cage is caused to occur at a G force of less than 1 and wherein, on completion of the wash cycle, feeding of the solid particulate cleaning material into said rotatably mounted cylindrical cage ceases and the G force on said rotatably mounted cylindrical cage is increased in order to effect a measure of drying of the cleaned substrate, wherein said increased G force is optionally between 10 and 1000, and wherein the G force is subsequently reduced to below 1 so as to allow for removal of the solid particulate cleaning material.

14. A method as claimed in claim 9 which additionally comprises separation and recovery of said solid particulate cleaning material and its re-use in subsequent washes, wherein said solid particulate cleaning material is optionally subjected to a cleaning operation either (a) in said lower chamber by sluicing said chamber with clean water or (b) in said rotatably mounted cylindrical cage.

15. A method as claimed in claim 9 wherein said solid particulate cleaning material comprises a multiplicity of polymeric particles and said polymeric particles optionally comprise particles of polyamides, polyesters, polyalkenes or polyurethanes or their copolymers and said washing treatment is optionally carried out so as to achieve a water to substrate ratio of between 2.5:1 to 0.1:1 w/w wherein the ratio of solid particulate cleaning material to substrate is optionally in the range of from 0.1:1 to 10:1 w/w, and wherein the wash cycle is optionally performed at temperatures of between 5 and 95° C. and for a duration of between 5 and 120 minutes.

16. A method for cleaning a soiled substrate, said method comprising the steps of:

(a) introducing a solid particulate cleaning material and water into the second lower chamber of an apparatus as claimed in claim 1;

(b) agitating and heating said solid particulate cleaning material and water;

(c) loading at least one soiled substrate into said rotatably mounted cylindrical cage via said access means;

(d) closing the access means so as to provide a substantially sealed system;

(e) introducing said solid particulate cleaning material and water into said rotatably mounted cylindrical cage via said recirculation means;

(f) operating the apparatus for a wash cycle, wherein said rotatably mounted cylindrical cage is caused to rotate and wherein fluids and said solid particulate cleaning material are caused to fall through said perforations in said rotatably mounted cylindrical cage into said second lower chamber in a controlled manner;

(g) operating said pumping means so as to transfer fresh solid particulate cleaning material and recycle used solid particulate cleaning material to said separating means;

(h) add said fresh and recycled solid particulate cleaning material to said rotatably mounted cylindrical cage in a controlled manner; and (i) continuing with steps (f), (g) and (h) as required to effect cleaning of the soiled substrate.

* * * * *